US006580044B2

(12) United States Patent
Ogawa et al.

(10) Patent No.: US 6,580,044 B2
(45) Date of Patent: Jun. 17, 2003

(54) SWITCH DEVICE AND METHOD OF ASSEMBLING SWITCH DEVICE

(75) Inventors: Satoshi Ogawa, Aichi (JP); Yoshiyuki Aoki, Aichi (JP); Kazuyoshi Ishiguro, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 16 days.

(21) Appl. No.: 09/811,486

(22) Filed: Mar. 20, 2001

(65) Prior Publication Data

US 2001/0025772 A1 Oct. 4, 2001

(30) Foreign Application Priority Data

Mar. 29, 2000 (JP) ..... P.2000-091013

(51) Int. Cl.[7] ..... H01H 13/14
(52) U.S. Cl. ..... 200/552; 200/345
(58) Field of Search ..... 200/552, 345, 200/5 A

(56) References Cited

U.S. PATENT DOCUMENTS 3,309,487 A * 3/1967 Fisher ..... 200/345
4,647,732 A * 3/1987 Yamanaka et al. ..... 200/552
5,712,459 A 1/1998 Ziegler ..... 200/5 R
6,239,726 B1 * 5/2001 Saida ..... 200/345 X

FOREIGN PATENT DOCUMENTS

DE 75 19 389 U 10/1975
JP 4-315715 * 11/1992 ..... 200/552

* cited by examiner

*Primary Examiner*—Renee Luebke
(74) *Attorney, Agent, or Firm*—Morgan, Lewis & Bockius LLP

(57) ABSTRACT

Two adjacent operation knobs (14, 15) are formed integrally with each other via a coupling portion (18) On the coupling portion (18), there are formed a V-shaped gap variable portion **(18*a*) and cylindrical portions (19) having positioning guide portions (20). There are provided pin-shaped positioning portions (22) on the switch body (11). To assemble the operation knobs (14, 15) to the switch body (11), each of the positioning guide portions (20) is mated with the positioning portions (22) and the front portion of the operation knobs (14, 15) is inserted into the opening (12). In cooperation with each of the positioning guide portions (20) and the positioning portions (22), the spacing dimension D2 between the operation knobs (14, 15)** is narrowed, for example, down to 0.5 mm or less, and the spacing dimension is to be sustained.

5 Claims, 4 Drawing Sheets

SWITCH DEVICE AND METHOD OF ASSEMBLING SWITCH DEVICE

BACKGROUND OF THE INVENTION

1. Technical Field

The present invention relates to a switch device and the method for assembling the same. The switch device has a configuration in which a plurality of operation knobs are arranged side by side on a switch body to allow them to be pushed therein.

2. Related Art

A configuration of a related switch device of this type will be explained with reference to FIGS. 5 and 6. A rectangular opening 1*a* elongated in a lateral direction is provided on a switch body 1. Guide ribs 1*b* are formed being positioned on the reverse side of the periphery of the opening 1*a*. In the opening 1*a*, two operation knobs 2, 3 are arranged side by side to be operatively depressed. The operation knobs 2, 3 comprise knob holders 2*a*, 3*a* and knobs 2*b*, 3*b* fitted in the front portion of the knob holders 2*a*, 3*a*, respectively. A wiring circuit board 4 is provided behind the operation knobs 2, 3. Push switches 5 corresponding to each of the operation knobs 2, 3 are arranged on he wiring circuit board 4.

In the aforementioned configuration, each of the operation knobs 2, 3 is positioned in an original position by the restorative force of the corresponding switches 5. When the operation knobs 2, 3 are operatively depressed, the operation knobs 2, 3 move along the guide ribs 1*b* to depress the corresponding switches 5, whereby the switches 5 output an operational signal. When the depressing force is released from the operation knobs 2, 3, the restorative force of the switches 5 allows the operation knobs 2, 3 to return into place.

The aforementioned related configuration provides the following drawbacks.

First, the two operation knobs 2, 3 require many parts since the operation knobs 2, 3 are arranged side by side being formed separately. The knob holders 2*a*, 3*a* and the knobs 2*b*, 3*b* are combined with each other to form each of the operation knobs 2, 3. In this case, the knob holders 2*a*, 3*a* and the knobs 2*b*, 3*b* of each of the operation knobs 2, 3 are fitted to each other wish some play present therebetween. Moreover, to guide the movement of the operation knobs 2, 3, a predetermined clearance is required between the knob holders 2*a*, 3*a* and the guide ribs 1*b* and between the knobs 2*b*, 3*b* and the opening 1*a*. Since many parts are required in the configuration, it is difficult to control the dimensions of each of the parts. For this reason, to prevent interference between the operation knobs 2, 3 caused by the play, the spacing dimension A (refer to FIG. 5) between the operation knobs 2, 3 is desirably made about 0.5 mm or more. This would not provide a good appearance, however, it was difficult to make the spacing dimension A shorter than this from the structural point of view.

SUMMARY OF THE INVENTION

The present invention is developed in view of the aforementioned circumstances. Its object is to provide a switch device and a method for assembling the same, in which the parts can be reduced in number, control of dimensions thereof can be comparatively facilitated, and an improved appearance can be provided.

In order to achieve the aforementioned object, a switch device comprises:

a switch body;

a plurality of operation knobs, arranged side by side, adapted to be pushed into the switch body for operating switches;

a coupling portion provided integrally with the plurality knobs with each other and allowing to vary a spacing between the adjacently operation knobs;

a plurality of positioning guide portions provided at positions of the coupling portion witch corresponds to each of the plurality of operation knobs; and a plurality of positioning portions provided a positions of the switch body which corresponds to each of the positioning guide portions for retaining the corresponding positioning guide portions, wherein the coupling portion is compressed when the plurality of positioning portions retain the corresponding positioning guide portions.

In order to achieve the aforementioned object, the invention provides a method of assembling a switch device wherein a plurality of operation knobs are arranged side by side and are allowed to be pushed into a switch body for operating a switches, said method comprising the steps of:

integrally forming the adjacent operation knobs with each other through a coupling portion for coupling the adjacent operation knobs so as to be allowed to vary a spacing between the adjacent operation knobs; and assembling the plurality of operation knobs to the switch body wherein a plurality of positioning portions provided at positions of the switch body retain the plurality of operation knobs and compress a spacing between the adjacent operation knobs in a cooperation with a plurality of positioning guide portions provided with the coupling portion.

DESCRIPTION OF PREFERRED EMBODIMENT

An embodiment of the present invention will be explained with reference to FIGS. 1(A) to 4.

Figure 2:
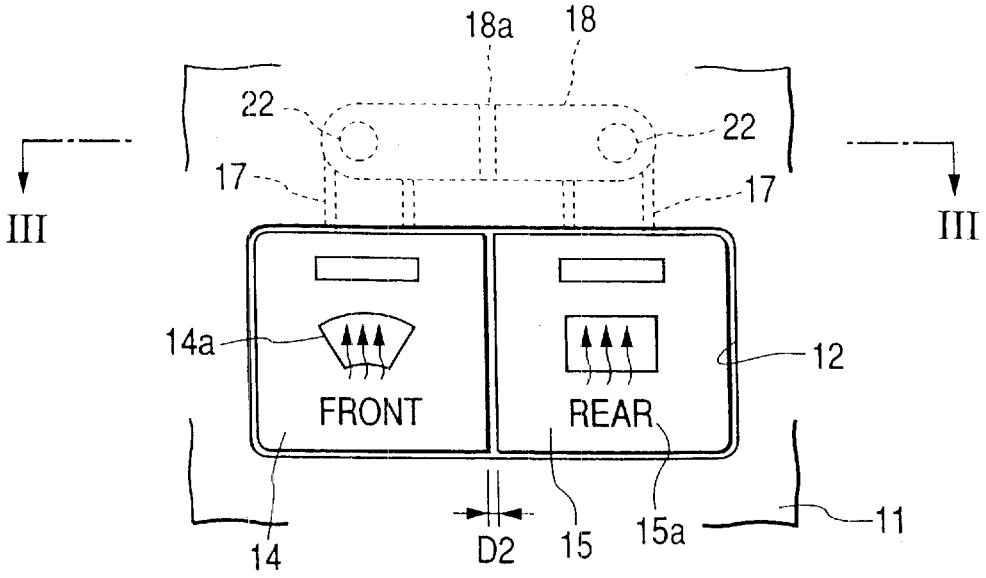
FIG. 2 is a front view of FIG. 1.
Figure 3:
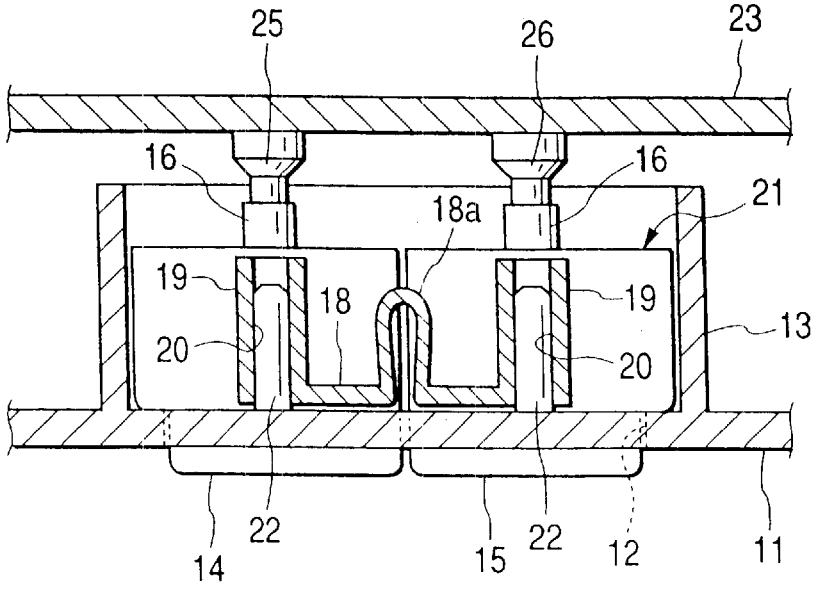
FIG. 3 is a cross-sectional plan view taken along line III—III of FIG. 2.
Figure 4A:
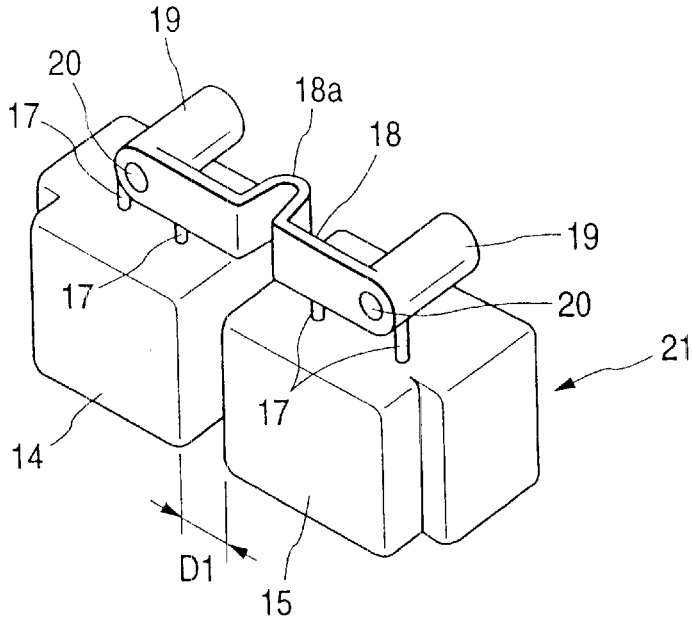
FIGS. 4(A) and (B) show a molded body, FIG. 4(A) being a perspective view illustrating the molded body in a free state, FIG. (B) being a perspective view illustrating the molded body placed in compression to narrow the spacing between operation knobs.
Figure 4B:
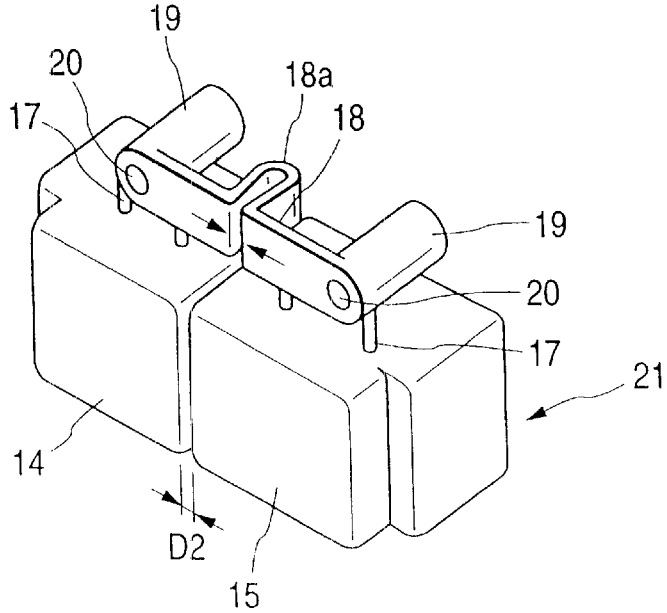
Figure 5:
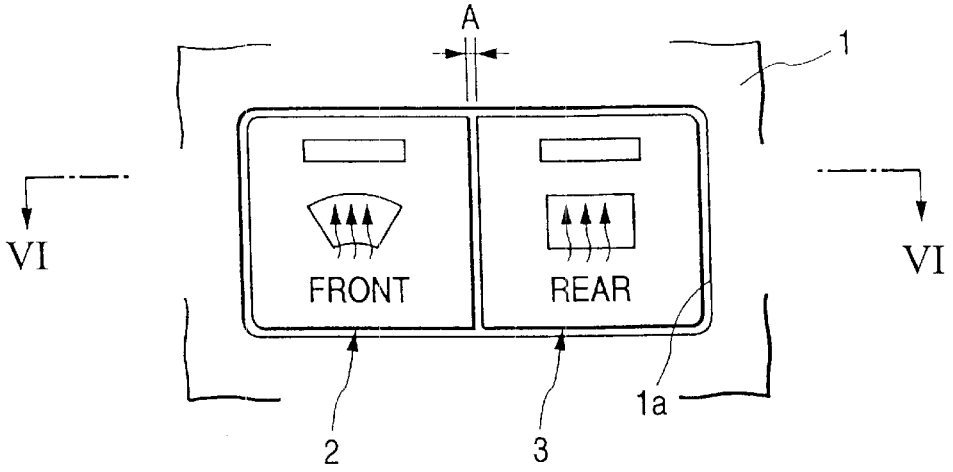
FIG. 5 PRIOR ART
FIG. 5 is a front view, equivalent to FIG. 2, illustrating a related art.
Figure 6:
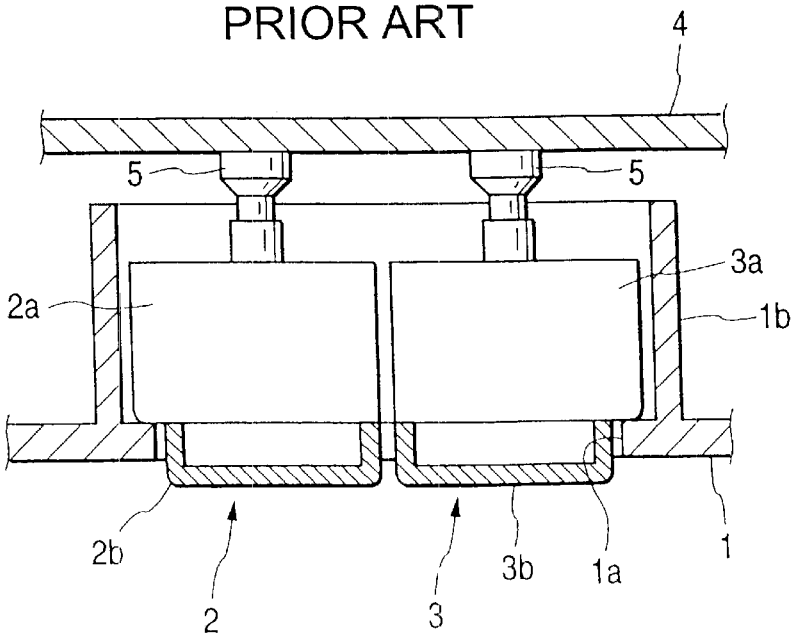
FIG. 6 PRIOR ART
FIG. 6 is a cross-sectional plan view taken along line VI—VI of FIG. 5.

First, referring to FIGS. 2 and 3, a rectangular opening 12 elongated in a lateral direction is provided on a switch body 11 made of synthetic resin. Guide ribs 13 are formed being positioned on the reverse of the rim portion of the opening 12. In the opening 12, a plurality of operation knobs 14, 15 (two knobs in this embodiment) made of synthetic resin are arranged side by side to be operatively depressed. The operation knob 14 on the left in FIG. 2 is to be used for defogging the front windshield of a vehicle, and the operation knob 15 is used for defogging the rear window of the vehicle. On the front of each of the operation knobs 14, 15, there are provided display portions 14*a*, 15*a* each corresponding to these uses.

As shown in FIGS. 1 and 4, each aforementioned two operation knobs 14, 15 has a structure of a general knob holder and a knob integrated with each other. On the rear portion of the operation knobs 14, 15, there are provided pressing portions 16 integrated therewith. A coupling portion 18 is formed on the side of each of the two operation knobs 14, 15 via two small connecting portions 17 protruded from the operation knobs 14, 15. The coupling portion 18 comprises: a gap variable portion 18*a* positioned at a position corresponding to the position between the two operation knobs 14,15; and cylindrical portions 19 formed integrally with the coupling portion 18. The gap variable portion 18*a* has generally the shape of a letter V and is allowed to be elastically deformed. The gap variable portion 18*a* couples the two operation knobs 14, 15 to allow the spacing therebetween to be changed. The cylindrical portions 19 are extended in the direction of movement of the operation knobs 14, 15. Circular holes inside the cylindrical portions 19 are used as positioning guide portions 20.

In this configuration, the two operation knobs 14, 15 and the coupling portion 18 are integrally molded with one another of synthetic resin via the connecting portions 17, the outer appearance of the molded body 21 being shown in FIG. 4.

The aforementioned switch body 11 has two pin-shaped positioning portions 22, 22 protruded from the reverse side of the rim portion of the opening 12 corresponding to the two positioning guide portions 20, 20. Each of the positioning portions 22, 22 is so dimensioned to be inserted into corresponding positioning guide portions 20, 20.

Figure 1A:
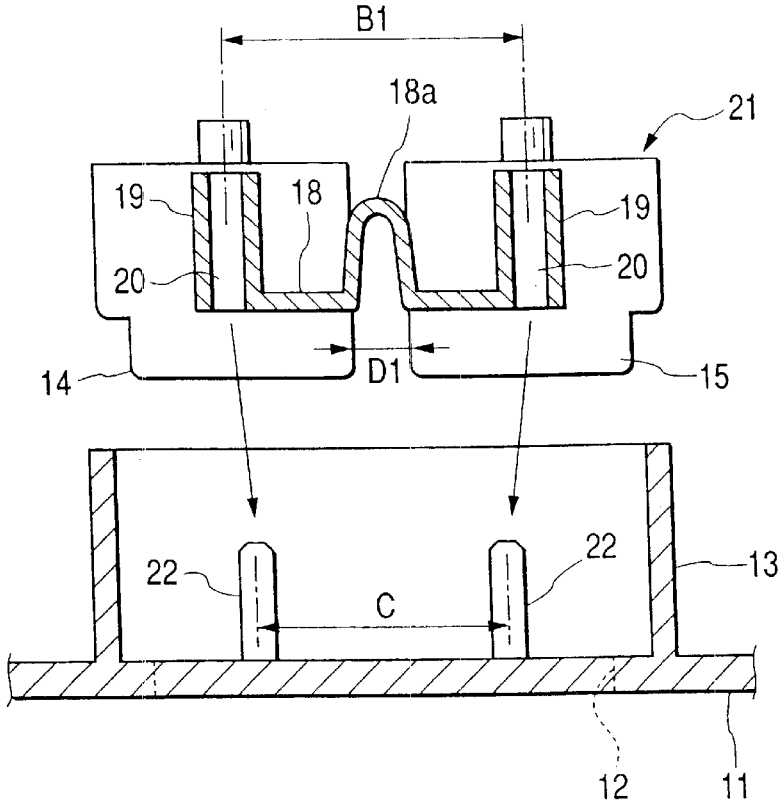
FIGS. 1(A) and 1(B) show an embodiment according to the present invention, FIG. 1(A) being a cross-sectional plan view illustrating the main portion thereof before assembly, FIG. 1(*b*) being a cross-sectional plan view illustrating the main portion thereof after assembly.
Figure 1B:
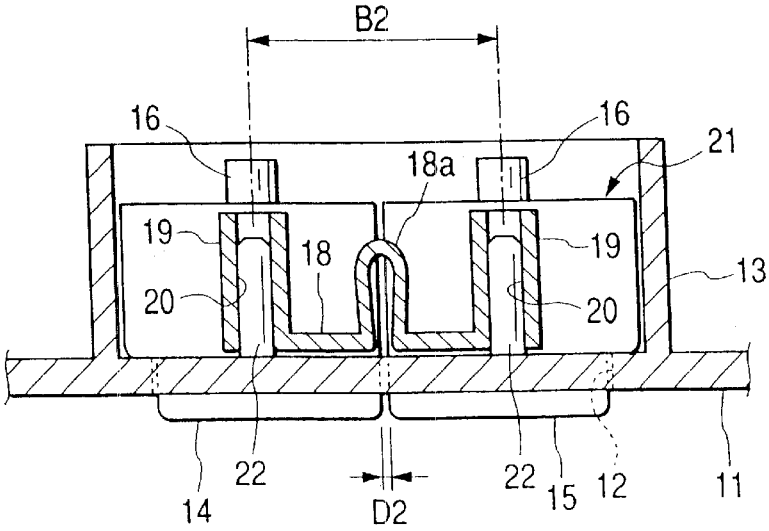

The procedure of assembling the aforementioned two operation knobs 14, 15 to the switch body 11 will be explained with reference to FIGS. 1(A), 1(B) and FIGS. 4(A) and 4(B). First, as shown in FIG. 1(A), the molded body 21 has the spacing dimension B1 between the centers of the two positioning guide portions 20 before assembly. The spacing dimension B1 is greater than the spacing dimension C between the centers of the two positioning portions 22, 22 on the switch body 11 (B1>C). The spacing dimension D1 between the two operating knobs 14, 15 is made 1 mm or more when the plurality of operation knobs 14, 15 are not retained by the two positioning portions 22, 22 so as to ensure the strength of the molded body upon molding the molded body 21.

Then, as shown in FIG. 1(A), the molded body 21 is arranged on the reverse side of the switch body 11. A shown in FIG. 1(B), each of the positioning guide portions 20 is fitted to the corresponding positioning portions 22. At the same time, the front portions of the two operation knobs 14, 15 are inserted into the opening 12. Thus, each of the positioning guide portions 20 is fitted to the corresponding positioning portions 22. In cooperation with each of the positioning guide portions 20 and the positioning portions 22, the spacing dimension B2 between the centers of the two positioning guide portions 20, 20 is narrowed to become equal to the spacing dimension C between the centers of the two positioning portions 22, 22. Consequently, the spacing dimension D2 between the two operation knobs 14, 15 is narrowed, for example, down to 0.5 mm, and the spacing dimension D2 is sustained. It is thus completed to assemble the two operation knobs 15, 15 to the switch body 11.

Referring to FIG. 3, a wiring circuit board 23 is arranged on the rear of the operation knobs 14, 15. Push switches 25, 26 corresponding to the pressing portions 16, 16 of each of the operation knobs 14, 15 are arranged on the wiring circuit board 23.

In the aforementioned configuration, each of the operation knobs 14, 15 is positioned in the original position by the restorative force of the corresponding switches 25, 26. When the operation knobs 14, 15 are depressed, the operation knobs 14, 15 move along the guide ribs 13 to depress the corresponding switches 25, 26, and the switches 25, 26 output an operation signal. When the depressing force is released from the operation knobs 14, 15, the restorative force of the switches 25, 26 allows the operation knobs 14, 15 to return into the original position.

This embodiment can provide the following effects.

First, the adjacent two operation knobs 14, 15 are integrated with each other via the connecting portions 17 and the coupling portion 18. Thus, this makes it possible to drastically reduce the parts employed in number, compared with the related configuration in which a knob holder and a knob are combined with each other to form individual operation knobs. Accordingly, the cost of the mold can be reduced and the steps of the assembly can be reduced in number as well, thereby making it possible to reduce the cost for the assembly and the cost for the entire device. Furthermore, the reduction in the number of parts will make it comparatively easy to control the dimensions of each of the parts employed.

In addition, the two operation knobs 14, 15 are assembled to the switch body 11. At this time, in cooperation with each of the positioning guide portions 20 provided on the coupling portion 18 and each of the positioning portions 22 provided on the switch body 11, the adjacent operation knobs 14, 15 are placed in compression and sustained with the spacing dimension D2 therebetween. This makes it possible to narrow the spacing dimension D2 between the adjacent operation knobs 14, 15 and improve the outer appearance of the overall switch device. Furthermore, the spacing dimension D2 between the adjacent operation knobs 14, 15 can be narrowed upon assembly. Therefore, upon molding the operation knobs 14, 15, the spacing dimension D1 between the operation knobs 14, 15 can be made comparatively wide enough to facilitate the molding.

The present invention is not limited to the aforementioned embodiment but may be modified or extended as follows.

The number of operation knobs 14, 15 is not limited to two but the configuration thereof can be designed so as to be provided with a series of three or more operation knobs.

The reversed projections and depressions can be applied to the positioning guide portions 20 and the positioning portions 22.

As is clear from the foregoing explanations, the present invention involves a plurality of adjacent operation knobs integrated with each other via a connecting portion. Therefore, compared with the related configuration in which a knob holder and a knob are combined with each other to form individual operation knobs, the parts can be reduced in number. Accordingly, the cost of the mold can be reduced and the steps of the assembly can be reduced in number as well, thereby making it possible to reduce the cost for the assembly and the cost for the entire device. Furthermore, the reduction in the number of parts will make it comparatively easy to control dimensions of each of the parts employed.

In addition, a plurality of operation knobs is assembled to the switch body. At this time, in cooperation with a plurality of positioning guide portions provided on the coupling portion and a plurality of positioning portions provided on the switch body, the adjacent operation knobs are placed in compression to be sustained with the spacing dimension therebetween. This makes it possible to narrow the spacing dimension between the adjacent operation knobs and improve the outer appearance of the overall switch device. Furthermore, the spacing dimension between the adjacent operation knobs can be narrowed upon assembly. For this reason, upon molding the operation knobs, the spacing dimension between the operation knobs can be made comparatively wide enough to facilitate the molding.

What is claimed is:

1. A switch device comprising:

a switch body;

a plurality of operation knobs, arranged side by side, adapted to be pushed into the switch body for operating switches;

a coupling portion provided integrally with the plurality of operation knobs so as to couple the plurality of operation knobs with each other, the coupling portion allows for varying of a lateral spacing between the adjacent operation knobs;

a plurality of positioning guide portions provided at positions of the coupling portion which correspond to each of the plurality of operation knobs; and a plurality of positioning portions provided at positions of the switch body which correspond to each of the positioning guide portions for retaining the corresponding positioning guide portions, wherein the coupling portion is compressed when the plurality of positioning portions retain the corresponding positioning guide portions and the positioning guide portions include a cylindrical portion adapted to insert the positioning portions therein.

2. The switch device according to claim 1, wherein the coupling portion includes a gap variable portion which is elastically deformable.

3. The switch device according to claim 1, wherein the plurality of operation knobs, the coupling portion and the plurality of positioning guide portions are integrally molded.

4. The switch device according to claim 1, wherein the spacing is 1 mm or more when the plurality of operation knobs are not retained by the plurality of positioning portions, the spacing is 0.5 mm or less when the plurality of operation knobs are retained by the plurality of positioning portions.

5. A method of assembling a switch device wherein a plurality of operation knobs are arranged side by side and are allowed to be pushed into a switch body for operating switches, said method comprising the steps of:

integrally forming the adjacent operation knobs with each other through a coupling portion for coupling the adjacent operation knobs so as to be allowed to vary a spacing between the adjacent operation knobs;

assembling the plurality of operation knobs to the switch body wherein a plurality of protruding positioning portions provided at positions of the switch body retain interior receiving portions of the plurality of operation knobs and compress a spacing between the adjacent operation knobs in a cooperation with a plurality of positioning guide portions provided with the coupling portion, wherein the plurality of protruding positioning portions include a cylindrical portion adapted to insert the positioning portions therein.

* * * * *